US005656045A

United States Patent [19]

Wiand

[11] Patent Number: 5,656,045

[45] Date of Patent: Aug. 12, 1997

[54] METHOD OF SPACED DISTRIBUTION FOR DIAMOND ABRASIVE ARTICLES

[76] Inventor: Ronald C. Wiand, 1494 Heatherwood Dr., Troy, Mich. 48098

[21] Appl. No.: 487,747

[22] Filed: Jun. 7, 1995

[51] Int. Cl.[6] ..... B24D 11/00

[52] U.S. Cl. ..... 51/295; 51/307; 51/309

[58] Field of Search ..... 51/293, 295, 307, 51/309

[56] References Cited

U.S. PATENT DOCUMENTS

| | | | |
|---|---|---|---|
| 4,776,862 | 10/1988 | Wiand | 51/293 |
| 4,883,500 | 11/1989 | Deakins et al. | 51/309 |
| 4,908,046 | 3/1990 | Wiand | 51/295 |
| 4,945,686 | 8/1990 | Wiand | 51/309 |
| 4,968,326 | 11/1990 | Wiand | 51/309 |
| 5,100,045 | 3/1992 | Wiand | 51/295 |
| 5,213,590 | 5/1993 | Neff | 51/309 |
| 5,271,547 | 12/1993 | Carlson | 51/309 |
| 5,437,754 | 8/1995 | Calhoun | 51/297 |

*Primary Examiner*—Deborah Jones
*Attorney, Agent, or Firm*—Harness, Dickey & Pierce, P.L.C.

[57] ABSTRACT

Spacing of diamond on a substrate is accomplished by mixing diamond and tungsten grits of approximately the same particle size and attaching it to a substrate.

14 Claims, No Drawings

METHOD OF SPACED DISTRIBUTION FOR DIAMOND ABRASIVE ARTICLES

BACKGROUND OF THE INVENTION

The present invention relates to diamond abrasive articles which use significant spacing between abrasive particles.

In the past there has been a need for abrasive articles which only require diamond grit in spaced locations on the particular diamond wheel disc grinding machine or the like, for instance that used on a wood sanding disc machine. Typically, in the past this type of spacing has been accomplished by hand, by usually moving diamond grit particles, one by one, on the particular substrate. Thereafter the diamond particles are attached either by adhesives or preferably by brazing to the substrate. The disadvantage in this prior art system is that there is no mechanized method for properly distributing spaced diamond grit in an automated manner.

The method typically used in the past for attaching diamond grit to substrates is described in many of my prior applications. Typically, the diamond grit material is mixed with various brazes or other attachment matrices. Thereafter, the mixture is distributed over the surface of the abrasive article and attached via brazing or the like. However, when seeking to space diamond grit particles at more than a natural distribution it is impossible to do this by the prior methods since the mixture is randomly distributed.

Thus, the option in the past has been either to manually place the particles, which is costly and labor intensive, or to use a normal distribution which is wasteful because it uses more diamond than is necessary.

Therefore, it has been a goal in the art to provide a method for reducing the steps necessary to provide an abrasive article wherein diamond particles are distributed onto the article with greater than normal distribution spaces therebetween without having the need for individual placement of the particles.

SUMMARY OF THE INVENTION

In accordance with the goals of the present invention there is provided a method of distribution of diamond grit material onto a substrate for making of an abrasive tool with wide spaces between the diamond grit. The method comprises providing a mixture of tungsten carbide abrasive grit and a diamond abrasive grit material which have about the same particle size. The mixture is mixed such that the particles are distributed homogeneously throughout the material. Thereafter, the mixture is distributed onto a substrate and attached onto the substrate.

The method of the present invention has the advantage that by using a normal method of distribution of the abrasive grit on the particular substrate the spacing of the diamond and the amount of diamond used can be reduced without requiring manual placement of diamond particles. Additionally, the use of tungsten carbide allows increased wear of the tool with very little reduction of performance.

Further understanding of the present invention will be by reference to the Description of the Preferred Embodiments, Examples and Claims set forth below wherein percentages are set forth by weight unless indicated otherwise.

DESCRIPTION OF THE PREFERRED EMBODIMENTS

In accordance with the present invention there is provided a method of distribution of a diamond grit material onto a substrate for the making of an abrasive tool which includes the steps as follows. First a mixture of a tungsten carbide abrasive grit material and a diamond abrasive grit material is provided. The mixture is then distributed onto a substrate. Thereafter, the mixture is attached onto the substrate. Utilizing the teachings of the present invention the diamond grit material is disbursed on the substrate at spaced locations and conserved.

Thus, in accordance with the present invention a mixture of the tungsten carbide abrasive grit material and a diamond grit abrasive material is provided. Preferably, the tungsten carbide grit size is substantially the same particle size as the diamond abrasive grit to insure random spaced distribution on the substrate. However, depending on the use the particle size may vary somewhat (i.e. from about a 2 to 1 particle diameter size tungsten carbide to diamond; to about a 1 to 2 ratio of particle size tungsten carbide to particle size of diamond particles). Additionally, the quantities may vary within specific ranges such that the ratio of tungsten carbide to diamond carbide is from about 10% to about 90% diamond grit. Typically the percentage of tungsten carbide to diamond grit is from about 25% to about 75% tungsten carbide and about 75% to about 25% diamond grit material and preferably from about 45% to about 55% tungsten carbide and from about 55% to about 45% diamond grit. A 50/50 mixture is particularly preferred.

The spacing between diamond particles can be adjusted by varying the quantities of diamond grit with tungsten carbide. While spacing of diamond particles may vary, typical spacing between diamond particles is from about less than one particle diameter to about greater than 20 particle diameters.

The mixture may be mixed by any known methods such as physical or ultrasonic agitation or the like. Preferably the mixture is mixed until it is substantially homogenous. Additionally, in the mixture if desired fluxes and brazing materials or the like maybe utilized to provide proper materials for brazing of the diamond and tungsten carbide onto a substrate. Typical additives in this regard are described in my U.S. Pat. Nos. 4,776,862; 5,100,045; 4,908,046; 4,945,686; and 4,968,326.

After thorough mixing into a homogenous state the mixture is distributed onto a substrate by sprinkling or otherwise applying it to the substrate as is conventionally known. Thereafter, a proper amount of heat is utilized and the mixture is secured to the abrasive substrate. Brazing methods are shown in my prior U.S. Pat. Nos. 4,776,862; 5,100,045; 4,908,046; 4,945,686; and 4,968,326. In operation, as the mixture is distributed over the surface, the diamond material is widely spaced over the particular surface reducing the cost of the abrasive article in the amount of the diamond grit used and reducing the labor involved in manually moving the diamond particles around. Thus, the cost of producing a diamond tool is reduced by the amount of tungsten carbide used in the mixture. Additionally, since the tungsten carbide performance is close to diamond performance the life of the tool is substantially maintained while reducing the amount of diamond necessary for a particular tool.

Further understanding of the present invention will be had by reference to the following examples, which are presented here for purposes of illustration but not limitation.

EXAMPLE 1

Abrasive articles are prepared in accordance with the following table.

TABLE 1

| SAMPLE | TUNGSTEN CARBIDE GRIT AMT. WT % | TUNGSTEN CARBIDE GRIT SIZE MICRONS | DIAMOND GRIT AMT. WT % | DIAMOND GRIT SIZE MICRONS | BRAZE MATERIAL | DIAMOND PARTICLE SPACING MICRONS |
|---|---|---|---|---|---|---|
| 1 | 50 | 260 | 50 | 260 | LM* | <260 |
| 2 | 25 | 450 | 75 | 500 | LM* | >600 |
| 3 | 10 | 260 | 90 | 260 | #51* | <500 |
| 4 | 60 | 450 | 40 | 500 | LM* | >400 |

*Wall Colmonoy Corporation, Madision Heights, Michigan

Each of the above samples are distributed in a mono layer over a steel plate substrate having the dimensions 4 inches by 4 inches. The plate is heated at a temperature of 1910° F. for brazing, the diamond particle spacing is summarized above. In the past this type of spacing of diamond particles could only be achieved using manual placement methods.

While the above description constitutes the preferred embodiments of the present invention, it is to be appreciated that the invention can be practiced in ways other than that specifically disclosed without deviating from the scope or the fair meaning of the present invention as set forth in the accompanying claims.

What is claimed is:

1. A method of spacing a diamond grit material on a substrate for making an abrasive tool, said method comprising:

(a) providing a homogeneous mixture of a tungsten carbide abrasive grit material and a diamond abrasive grit material wherein said tungsten carbide grit material has a particle size which varies from ½ to 2 times the particle size of the diamond grit;

(b) distributing the mixture onto a substrate: and (c) attaching said mixture to the substrate.

2. The method of claim 1 wherein the mixture comprises from about 10% to about 90% tungsten carbide and from about 90% to about 10% diamond grit.

3. The method of claim 1 wherein said mixture is attached by brazing.

4. The method of claim 1 wherein the tungsten carbide grit material has a particle size which is about equal to the particle size of the diamond.

5. The method of claim 1 wherein the spacing between diamond particles is from less than about 1 diamond particle diameter to greater than 20 diamond particle diameters.

6. The method of claim 1 wherein the mixture comprises from about 25% to about 75% tungsten carbide and from about 75% to about 25% diamond grit.

7. The method of claim 1 wherein the mixture comprises about 50% tungsten carbide and about 50% diamond grit.

8. The method of claim 1 wherein the mixture comprises from about 45% to about 55% tungsten carbide and from about 55% to about 45% diamond grit.

9. An abrasive article having spaced diamond grit particles, said article comprising a substrate having a homogeneous mixture of tungsten carbide grit particles and diamond grit particles distributed and attached thereon.

10. The abrasive article of claim 9 wherein the space between the diamond grit particles is from less than about 1 diamond particle diameter to greater than about 20 particle diameters.

11. The abrasive article of claim 9 wherein the tungsten carbide grit particles have a particle size which varies from about ½ to about 2 times the particle size of the diamond grit.

12. The abrasive article of claim 9 wherein the mixture comprises from about 10% to about 90% tungsten carbide and 90% to about 10% diamond grit.

13. The abrasive article of claim 9 wherein the mixture comprises from about 25% to about 75% tungsten carbide and 75% to about 25% diamond grit.

14. The abrasive article of claim 9 wherein the mixture comprises from about 45% to about 55% tungsten carbide and 55% to about 45% diamond grit.

* * * * *